United States Patent [19]

Leskovec et al.

[11] Patent Number: 4,555,647

[45] Date of Patent: Nov. 26, 1985

[54] BALLAST CIRCUIT FOR GAS DISCHARGE TUBES UTILIZING TIME-PULSE ADDITIONS

[75] Inventors: Robert A. Leskovec, Richmond Hts.; John M. Davenport, Lyndhurst; Pieter J. von Herrmann, Shaker Hts., all of Ohio

[73] Assignee: General Electric Company, Schenectady, N.Y.

[21] Appl. No.: 749,129

[22] Filed: Jun. 27, 1985

Related U.S. Application Data

[63] Continuation of Ser. No. 538,246, Oct. 3, 1983, abandoned.

[51] Int. Cl.[4] ..... H05B 35/00

[52] U.S. Cl. ..... 315/179; 315/58; 315/71; 315/163; 315/166; 315/241 R

[58] Field of Search ..... 315/179, 163, 166, 71, 315/58

[56] References Cited

U.S. PATENT DOCUMENTS

| | | | |
|---|---|---|---|
| 2,391,611 | 12/1945 | Back | 315/241 R |
| 3,007,081 | 10/1961 | Sebastin | 315/241 R |
| 3,403,293 | 9/1968 | Michelsen | 315/176 |
| 3,527,982 | 9/1970 | Lake | 315/179 |
| 3,546,529 | 12/1970 | Griffin | 315/176 |
| 3,987,356 | 10/1976 | Steigerwald | 321/10 |
| 4,042,856 | 8/1977 | Steigerwald | 315/246 |
| 4,161,672 | 7/1979 | Cap et al. | 313/220 |
| 4,316,124 | 2/1982 | Verwimp et al. | 315/179 |
| 4,320,325 | 3/1982 | Anderson | 315/205 |
| 4,350,930 | 9/1982 | Peil et al. | 315/49 |
| 4,471,268 | 9/1984 | Brown et al. | 315/179 |

*Primary Examiner*—Harold Dixon

*Attorney, Agent, or Firm*—John P. McMahon; Philip L. Schlamp; Fred Jacob

[57] ABSTRACT

Ballast circuits for a gas discharge tube are disclosed. One embodiment of a single-phase non-inductive ballast for operation of a gas discharge tube by direct current (D.C.) using a resistive current-limiting means and a relatively small capacitor is disclosed. The D.C. ballast circuit generates a timed pulse addition (TPA). The D.C. ballast circuit includes an arrangement of switching means which controls the discharge of a capacitive energy storage means so as to supply the reignition and the restrike energy in the form of timed pulse additions (TPA) that may be needed for the gas discharge tube. Other embodiments are disclosed for the ballast circuit which operate directly from the A.C. line and control the discharge of a capacitive storage means to supply reignition and restrike energy in the form of timed pulse additions (TPA) that may be needed for the gas discharge tube.

7 Claims, 14 Drawing Figures

Fig. 3
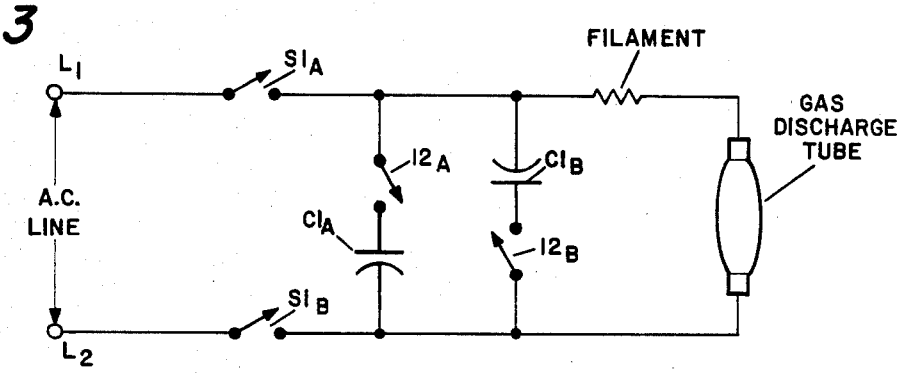
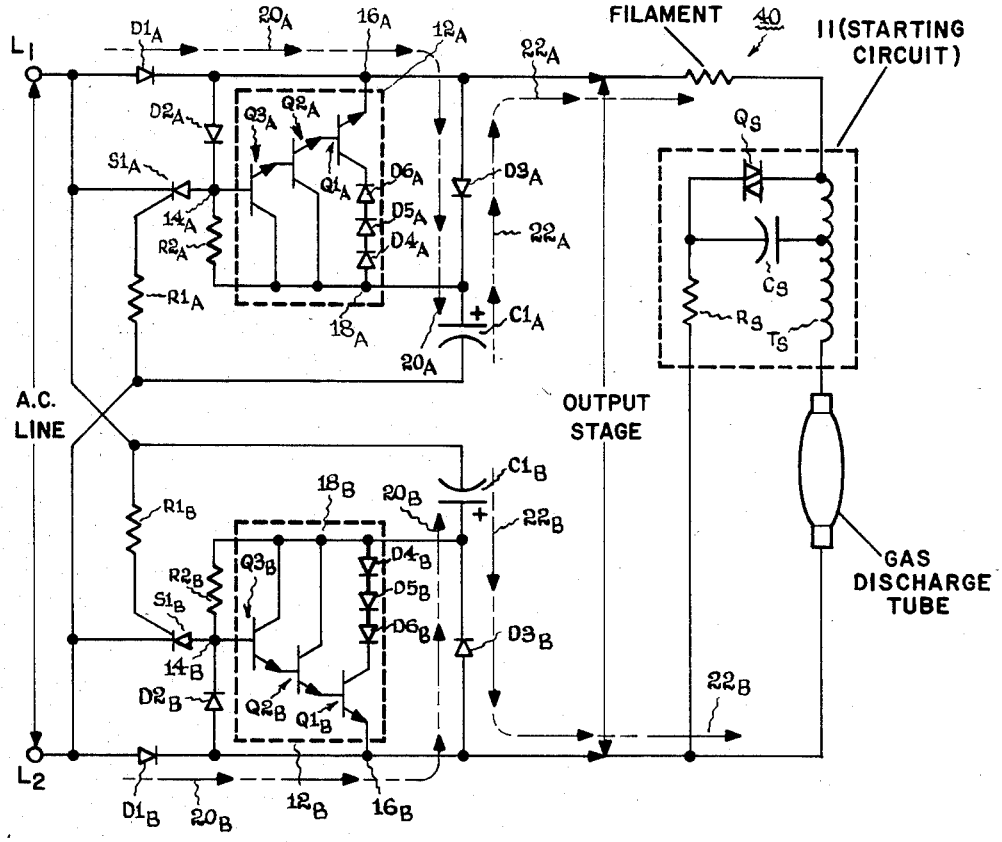
Fig. 5

BALLAST CIRCUIT FOR GAS DISCHARGE TUBES UTILIZING TIME-PULSE ADDITIONS

This application is a continuation, of application Ser. No. 538,246, filed Oct. 3, 1983 now abandoned.

BACKGROUND OF THE INVENTION

The present invention relates to a ballast circuit for gas discharge tubes. More particularly, the present invention relates to a ballast circuit for gas discharge tubes having applied an alternating current (A.C.) or a direct current (D.C.) voltage source.

Recent improvements to the incandescent art have provided an improved lighting unit having a highly efficient gas discharge tube as the main light source and an incandescent filament as a supplementary light source. Such an improved incandescent lamp is generally described in U.S. Pat. No. 4,350,930, of Piel et al, issued Sept. 21, 1982, and which is assigned to the same assignee as the present invention.

The gas discharge tube has various modes of operation such as, (1) an initial high voltage breakdown mode, (2) a glow-to-arc transition mode, and (3) a steady state run mode. One of the circuit performance parameters is that the voltage applied across the gas discharge tube be such that the current flowing within the gas discharge tube is maintained above a critical value such as 60 milliamps. If the current flowing in the gas discharge tube drops below this critical value the arc condition of the gas discharge tube may extinguish, which, in turn, may cause the gas discharge tube to revert from its steady state run mode to its glow-to-arc transition mode or even to the initial breakdown mode. The reestablishment of the desired arc condition of the gas discharge tube may require a restrike voltage having a value typically 2.5 times or more than that of the operating voltage of the gas discharge tube.

The restrike voltage necessary for a gas discharge tube of 2.5 times its operational voltage presents a difficulty for a ballast circuit for a discharge tube operating directly from a 120 volt, 60 Hz A.C. source. For example, if the gas discharge tube has an operating voltage of 80 volts A.C. a restrike voltage of $80 \times 2.5 = 200$ volts or more is typically necessary and which voltage value is not ordinarily available from the peak-voltages of a typical 120 volt, 60 Hz A.C. source.

The gas discharge tube may be successfully operated by a ballast circuit developing a D.C. type operating voltage for the gas discharge tube. Such ballast circuits are as described in the previously mentioned U.S. Pat. No. 4,350,930, U.S. Pat. No. 4,320,325 of T. E. Anderson, issued Mar. 16, 1982, U.S. application Ser. No. 463,753, filed Feb. 4, 1983 of V. Roberts, and U.S. application Ser. No. 488,849, filed Apr. 26, 1983 of J. Davenport, all of which are assigned to the same assignee as the present invention.

The gas discharge tube may also be successfully operated by a ballast circuit operating directly from an A.C. voltage source and developing an A.C. operating voltage for the gas discharge tube. Such a ballast circuit is described in U.S. application Ser. No. 488,833, filed Apr. 26, 1983 of J. Davenport et al., and assigned to the same assignee of the present invention.

Although all of the hereinbefore mentioned ballast circuits will serve their desired function, it is desired that a ballast circuit be provided having applications to both direct current (D.C.) and alternating current (A.C.) supplied voltage.

Further it is desired that the ballast circuit supply only the desired amount of energy necessary to maintain the arc condition of the gas discharge tube.

Still further, it is desired that the ballast circuit, applicable to both D.C. and A.C. applications, be provided with means effective to easily adapt the ballast circuit to various needs of the arc discharge tube.

Accordingly, objects of the present invention are (1) provide ballast circuits applicable to both A.C. and D.C. applied voltages, (2) provide ballast circuits that supply only the desired amount of energy to the gas discharge tube which is necessary to maintain the arc condition of the gas discharge tube, and (3) provide the ballast circuits with means effective to be easily adaptable to various needs of the arc discharge tube.

SUMMARY OF THE INVENTION

In accordance with the present invention a lighting unit is provided having various ballast circuits capable of operating with an applied alternating current (A.C.) or direct current (D.C.) source. The ballast circuit supplies timed pulse additions (TPA) at predetermined durations of the applied voltage, to a discharge tube of the lighting unit so that the arc condition of the gas discharge tube is continuously maintained.

The lighting unit has the gas discharge tube as its main light source, a filament serving as a resistive element and as a supplementary light source, and a ballast circuit adapted to accept an applied voltage across its first and second input terminals. The ballast circuit has an output stage capable of accepting across its first and second output terminals a serial arrangement of a filament and a gas discharge tube having a starting circuit.

The lighting unit has an improved ballast circuit comprising a capacitive energy storage means provided with means for charging during a preselected portion of the applied voltage and having one end connected to one of the input terminals of the ballast circuit. The ballast circuit further comprises switching means connected to the other end of the capacitive energy storage means and bias network means coupled to the switching means and responsive to a selected portion of the applied voltage effective to render the switching means conductive, which, in turn, causes the energy stored in the capacitive energy device to be discharged into the gas discharge tube.

The subject matter which is regarded as the invention is particularly pointed out and distinctly claimed in a concluding portion of the specification. The invention, however, both as to its construction and method of operation, together with further objects and advantages thereof may best be understood by reference to the following description taken in conjunction with the accompanying drawings.

BRIEF DESCRIPTION OF THE DRAWINGS

FIG. 3 is a simplified diagram of the circuit arrangement of FIG. 2.

FIG. 5 is a circuit arrangement of another embodiment of the present invention.

DETAILED DESCRIPTION OF THE PREFERRED EMBODIMENT

Figure 1:
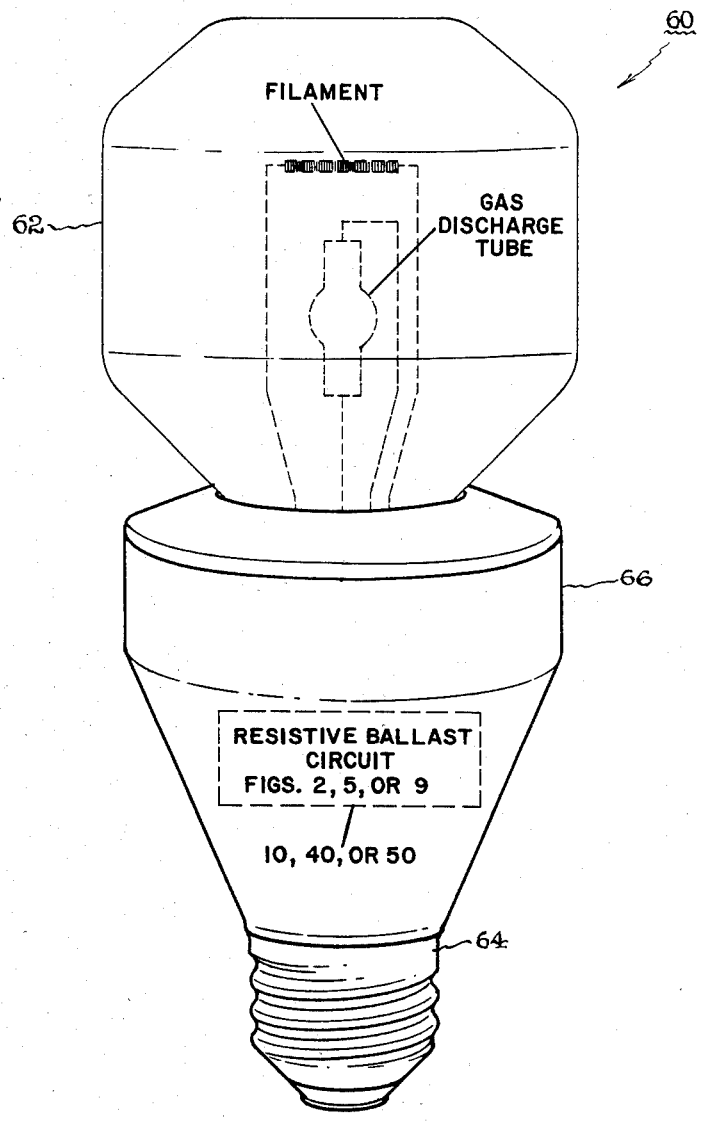
FIG. 1 shows a lighting unit in accordance with the present invention.

FIG. 1 shows a lighting unit 60 having a gas discharge tube (shown in phantom) as the main light source, and a filament as a supplementary light source (also shown in phantom) spatially disposed within a light-transmissive outer envelope 62. The lighting unit 10 has an electrically conductive base 64 and a housing 66 for lodging the electrical components of the lighting unit 10. FIG. 1 further shows the housing 66 as confining resistive ballast circuit 10, 40, or 50 shown more clearly respectively in FIGS. 2, 5, or 9.

Figure 2:
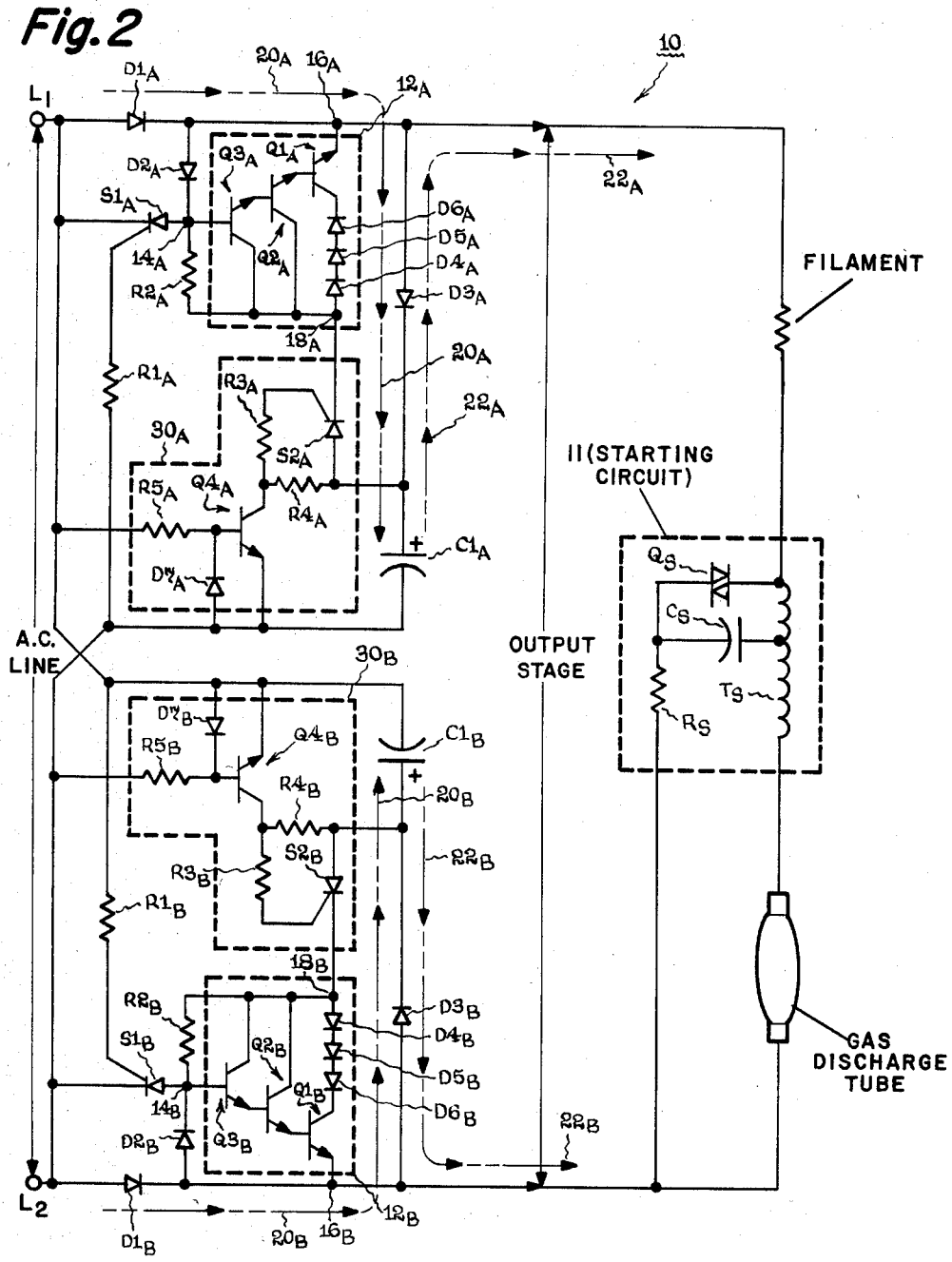
FIG. 2 is a circuit arrangement in accordance with one embodiment of the present invention.

FIG. 2 shows a circuit arrangement 10 of one embodiment of the present invention of an operating or ballast circuit for the gas discharge tube which may be of the highly efficient type described in U.S. Pat. No. 4,161,672 of D. M. Cap and W. H. Lake, issued July 17, 1979, and which is assigned to the same assignee as the present invention. As discussed in the "Background" section, the gas discharge tube has a steady state run mode of operation. The operating or ballast circuit 10 provides the necessary conditions to prevent the extinction of the arc condition of the gas discharge tube during its steady state run mode of operation. The operating or ballast circuit 10, by means of discharging energy stored in a capacitor as the voltage applied to the gas discharge tube transitions to its low value, supplies or controls the necessary energy applied to the gas discharge tube to prevent the extinction of the arc condition of the gas discharge tube during the steady state run mode of operation. The ballast circuit controlling the steady state run mode of operation of the gas discharge tube is effectively in parallel with the gas discharge tube and filament arrangement until the ballast circuit is rendered conductive at which time the ballast circuit discharges, in a serial manner, the energy stored in its capacitor into the gas discharge tube and filament arrangement. Conversely, the filament is continuously arranged in a serial manner with the gas discharge tube to supply a resistive, current-limiting function for the gas discharge tube. The ballast circuit 10 is arranged to accept an alternating current (A.C.) source applied across its first $L_1$ and a second $L_2$ input terminals.

In general, the ballast circuit 10, and also ballast circuits 40 and 50, to be described, has means to provide a charge for a capacitive energy storage means having one of its ends coupled to a switching means. The switching means has a bias network which is responsive to an applied voltage so as to render the switching means conductive during a preselected portion of the applied A.C. voltage.

The output stage of the circuit arrangement 10 is capable of accepting across its first and second output terminals a serial arrangement of a tungsten filament and a gas discharge tube having a starting circuit. The ballast circuit 10 comprises a first capacitor energy storage device $C1_A$ and a second capacitor storage device $C1_B$. The circuit arrangement 10 has means, shown as diodes $D1_A$, $D3_A$, $D1_B$ and $D3_B$, for providing a path for the A.C. voltages to charge the capacitor energy storage devices $C1_A$ and $C1_B$ each during a preselected portion of the A.C. voltages. The ballast circuit further comprises a first $12_A$ and a second $12_B$ current control device respectively related to the capacitor energy storage devices $C1_A$ and $C1_B$. The first $12_A$ and the second $12_B$ are conditionally responsive to the applied A.C. voltage through their respective bias networks, so as to provide a path to discharge their respective capacitor energy storage device $C1_A$ or $C1_B$ at selected portions of the A.C. voltage signal so that extinction of the gas discharge tube during its steady-state mode of operation is prevented. Further, the characteristics of $12_A$ and $12_B$ are such as to always direct the discharge preferentially through the discharge tube and never back into the A.C. supply line.

FIG. 2 shows the arrangement of the starting circuit 11 as comprised of a plurality of conventional elements of the type indicated or having typical component values both as given in Table 1.

| Element | Typical Value or Type |
|---|---|
| $Q_S$ | SIDAC type K1200E of Teccor Co., Dallas, Texas 75261. |
| $C_S$ | Capacitor 0.05 μF/400 volts. |
| $T_S$ | Autotransformer construction using a pair of Ferroxcube, Saugerties, NY 12477 type 813E187-3E2A E cores and a type 990-023-01 bobbin wound with a 20 turn primary and a 400 turn secondary using #30 enamel covered wire. |
| $R_S$ | Resistor having a value of 15K Ω and a rating of 1 watt. |

The starting circuit 11 provides the necessary voltages so as to transition the gas discharge tube from its (1) initial state requiring a high applied voltage to cause an initial arcing of the gas discharge tube, (2) to its glow-to-arc mode, and then (3) its final steady state run condition. The starting circuit 11 operates in the following manner, (1) when the gas discharge tube is initially energized it is a relatively high impedance device so that the current initially flows through $R_S$ charging $C_S$, (2) when the voltage on capacitor $C_S$ equals or exceeds the breakdown or turn-on voltage (approximately 120 volts) of the SIDAC $Q_S$, connected in a parallel manner across $C_S$, via a ferrite transformer $T_S$, $Q_S$ is rendered conductive, (3) the conductive $Q_S$ provides a low impedance path so that the energy stored on capacitor $C_S$ is suddenly discharged, through the primary of $T_S$ which produces a potential sufficient for ionization of the gas discharge tube, (4) this discharge energy is of a sufficient magnitude to cause an initial arcing condition of the gas discharge tube, (5) the gas discharge tube then sequences from its initial state to its glow-mode and finally to its steady-state run mode, (6) when the gas discharge tube is in its steady state run condition it becomes a relatively low impedance and low voltage device so that the current is preferentially directed to the gas discharge tube, and finally (7), the starting circuit 22 is effectively removed from the ballast circuit 20 since the conducting lamp prevents the voltage on $C_S$ from reaching the turn on voltage of the SIDAC QS.

The circuit arrangement 10 has two symmetrical sub-arrangements, shown by the use of subscripts A and B, with each sub-arrangement having a plurality of conventional elements of the type or having the typical component values given in Table 2.

TABLE 2

| Elements | Type |
|---|---|
| S1 and S2 | Silicon controlled Rectifier C106D1 of the General Electric Co. |
| R1 | 51K Ω, ½ watt carbon composition resistor |
| R2 | 110K Ω, ¼ watt resistor |
| R3 | 110K Ω, ¼ watt resistor |
| R4 | 110K Ω, ¼ watt resistor |
| R5 | 110K Ω, ¼ watt resistor |
| D1, D2, D3, D4, D5, D6, and D7 | 1 amp, 400 PIV Silicon Diode |
| Q1 | Motorola Silicon Transistor, NPN, MJE 13004 |
| Q2, Q3, and Q4 | Motorola Silicon Transistor NPN 2N6517 |

The circuit arrangement 10 further comprises the capacitor energy storage devices $C1_A$ and $C1_B$ having a capacitive value of 10 microfarads, but alternatively having other values selected in accordance with various embodiments of the present invention to be described.

The two sub-arrangements having the subscripts A or B operate in a similar manner with the sub-arrangement A controlling the operation of circuit 10 during the positive portion of the applied A.C. voltage and sub-arrangement B controlling the operation of circuit 10 during the negative portion of the applied A.C. voltage. The circuit arrangement of sub-arrangements A and B are essentially the same in a structural manner and for the sake of brevity only the structural arrangement of circuit sub-arrangement A is described with the understanding that this description is equally applicable to the circuit of sub-arrangement B.

The current controlled device $12_A$ of subarrangement A has three terminals $14_A$, $16_A$, and $18_A$. The terminal $14_A$ is connected to the node formed from three devices (1) the cathode of a forward conducting diode $D2_A$ which has its anode connected to one side of the output stage, and to the cathode of a forward conducting diode $D1_A$, (2) one end of a resistor $R2_A$ which has its other end connected to the terminal $18_A$ of device $12_A$, and (3) the anode of the switching means $S1_A$ which has its cathode connected to the terminal L1 and its gate connected to one end of resistor $R1_A$ which, in turn, has its other end connected to the cathode of the switching means $S1_B$, terminal L2, and to a network $30_A$.

Network $30_A$ is comprised of a switching means $S2_A$, transistor $Q4_A$, diode $D7_A$, and resistors $R3_A$, $R4_A$ and $R5_A$. The diode $D7_A$ has its anode connected to one side of capacitor $C1_A$ and its cathode connected to the base of transistor $Q4_A$ and also to one end of resistor $R5_A$, which, in turn, has its other end connected to the cathode of switching means $S1_A$.

The transistor $Q4_A$ has its emitter connected to the side of capacitor $C1_A$. The collector of transistor $Q4_A$ is connected to a node formed from one end of each resistor $R3_A$ and $R4_A$. The other end of resistor $R3_A$ is connected to the gate of switching means $S2_A$, whereas, the other end of resistor $R4_A$ is connected to the anode of switching means $S2_A$. The cathode of switching means $S2_A$ is connected to a terminal $18_A$ of the current controlled device $12_A$. The second terminal $16_A$ of device $12_A$ is connected to one side of the output stage of circuit 10.

The current control device $12_A$ is comprised of a serial arrangement of transistors $Q3_A$, $Q2_A$ and $Q1_A$. The collector of transistor $Q1_A$ has a serial arrangement of diodes $D5_A$, $D6_A$ and $D7_A$. For the embodiment shown in FIG. 2 the diodes $D5_A$, $D6_A$ and $D7_A$ are desired to provide a voltage drop across their terminals to assure saturation of device $12_A$ during its forward current flow.

The operation of one embodiment of the present invention shown as circuit arrangement 10 of FIG. 1 may best be described by first referring to a simplified diagram of circuit arrangement 10 which is shown in FIG. 3. FIG. 3 shows the capacitor $C1_A$ as interrelated to the first current control device $12_A$ and the first switching means $S1_A$, whereas, the capacitor $C1_B$ is shown as interrelated to the second current control device $12_B$ and the second switching means $S1_B$.

In general, the capacitor $C1_A$ and $C1_B$ are charged during the peak voltages of the applied A.C. voltage and then discharged under the control of $12_A$ and $12_B$, respectively, into the gas discharge tube when reignition or restrike energy is needed for the gas discharge tube which condition typically occurs when the applied A.C. voltage transitions through its zero condition. The discharge energy or timed pulse addition of $C1_A$ and $C1_B$ allows the arc condition of the gas discharge tube during its steady state mode of operation to be continuously maintained. The portions of the applied A.C. voltage are preferentially and adaptively selected so that the timed pulse addition (TPA) supplied by the discharge of the capacitor $C1_A$ and $C1_B$ is only accomplished when the gas discharge tube desires such additions for inhibiting the arc condition extinction. The desired selected portions of the applied A.C. voltage at which the capacitor $C1_A$ and $C1_B$ are discharged are best described with reference to FIG. 4.

Figure 4:
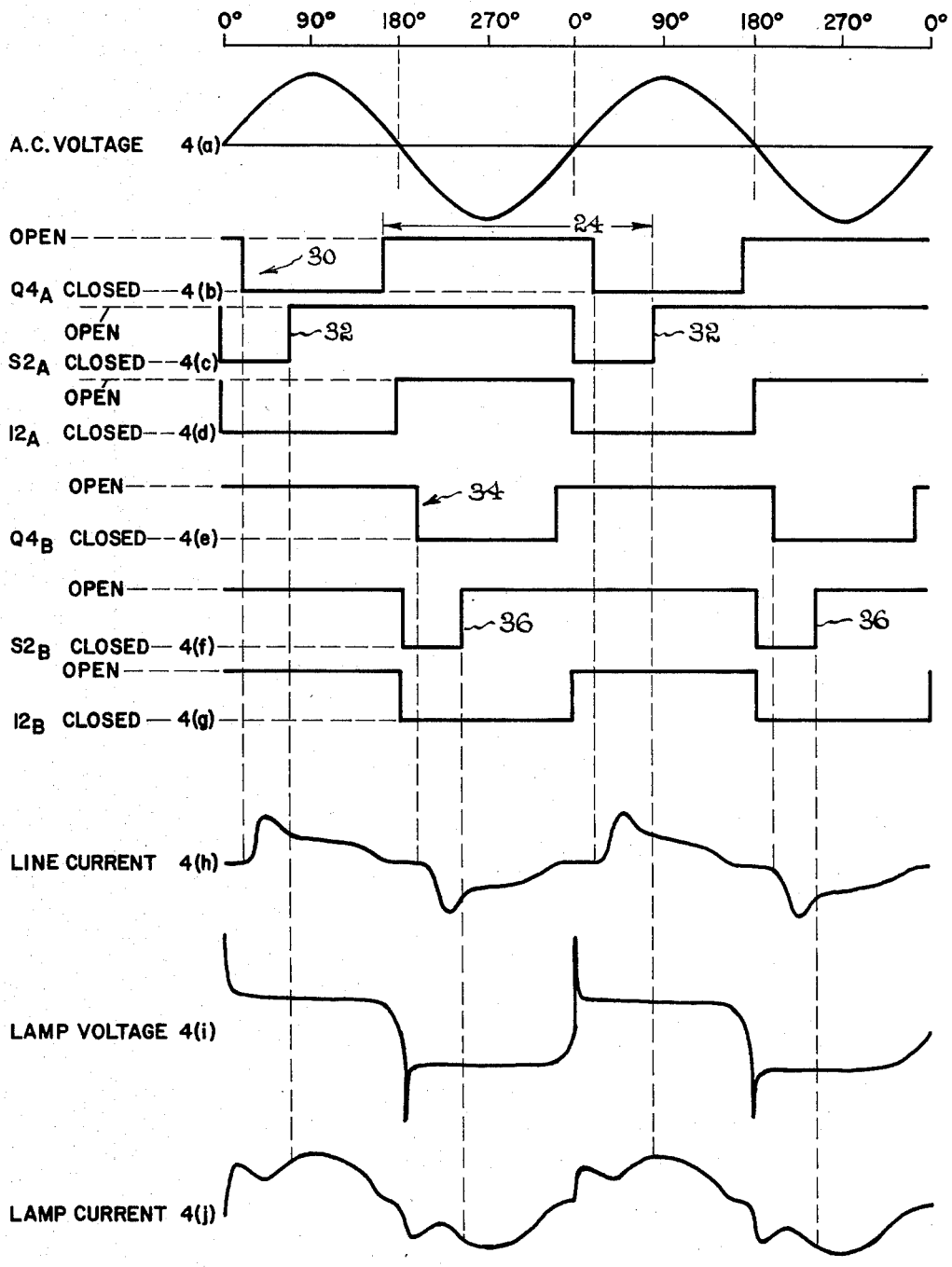
FIG. 4 is a timing diagram related to the operation of the circuit of FIG. 2.

FIG. 4 is segmented into ten sub-sections shown as: (1) FIG. 4(*a*) showing an A.C. voltage having an uppermost portion with a 0° to 360° variation of the A.C. voltage; (2) FIG. 4(*b*) showing the open (non-conductive) and closed (conductive) states of the transistor $Q4_A$; (3) FIG. 4(*c*) showing the closed (conductive) and open (non-conductive) states of switching means $S2_A$; (4) FIG. 4(*d*) showing the closed (conductive) and open (non-conductive) states of current controlled device $12_A$; (5) FIG. 4(*e*) showing the closed (conductive) and open (non-conductive) states of transistor $Q4_B$; (6) FIG. 4(*f*) showing the closed (conductive) and open (non-conductive) states of switching means $S2_B$; (7) FIG. 4(*g*) showing the closed (conductive) and open (non-conductive) states of the current controlled device $12_B$; (8) FIG. 4(*h*) showing the line current flowing into terminal $L_1$ and out of terminal $L_2$ and defined as "positive" in polarity; (9) FIG. 4(*i*) showing the waveform of the lamp voltage which is the voltage applied across the gas discharge tube of FIG. 2 defined as positive on top, measured with respect to bottom as drawn; and (10) FIG. 4(*j*) showing the waveform of the lamp current flowing in the gas discharge tube of FIG. 2 defined as positive when flowing in the same direction as the previously defined flow of line current of FIG. 4(*h*).

From FIG. 4(*i*) it should be noted that the lamp voltage has a waveshape which resembles a square wave. Furthermore, the initial positive and negative portions of the square-wave of FIG. 4(*i*) are respectively sharply rising and sharply falling types. The waveshape of FIG. 4(*i*) is of substantial importance to the present invention in that the circuit arrangement 10 of FIG. 2 generates this type waveshape even though the applied A.C. voltage of FIG. 4(*a*) which periodically transitions through its zero conditions with a typical sinusoidal shape may cause the arc condition of the gas discharge tube to experience an extinction. Still further, the practice of the present invention only generates the spike-like or capacitive-kick timed pulse addition (TPA) when it is necessary to prevent extinction of the arc condition of the gas discharge tube.

A comparison between FIGS. 4(*a*) and 4(*i*) reveals that the sharply rising and sharply falling portions of the square wave of FIG. 4(*i*) are respectively related to the 0° and 180° portions of A.C. voltage of FIG. 4(*a*). The sharply rising portions of the lamp voltage of FIG. 4(*i*) are controlled by: (1) the open and closed states of the transistor $Q4_A$ of FIG. 4(*b*); (2) the open and closed state of the switching means $S2_A$ of FIG. 4(*c*); and (3) the open and closed states of the current control device $12_A$ of FIG. 4(*d*), whereas, the sharply falling portions of the lamp voltage of FIG. 4(*i*) are controlled by (1) the open and closed states of the transistor $Q4_B$; (2) the open and closed states the switching means $S2_B$ of FIG. 4(*f*); and (3) the opened and closed states of the current control device $12_B$ of FIG. 4(*g*).

It should be noted that FIG. 4(*c*) and FIG. 4(*h*) are related by an event 30, and that FIG. 4(*d*) and FIG. 4(*j*) are related by an event 32. Similarly from FIG. 4 it should be noted that, FIG. 4(*f*) and FIG. 4(*h*) are related by an event 34 and that FIG. 4(*g*) and FIG. 4(*j*) are related by an event 36. The events 30 and 34 are related to the zero condition of the line current of FIG. 4(*h*) and the events 32 and 36 are related to the lamp current of FIG. 4(*j*).

The sharply rising and sharply falling portions of the square wave waveform of the lamp voltage of FIG. 4(*i*) are provided by preferentially discharging the energy stored in $C1_A$ and $C1_B$ into the gas discharge tube of FIG. 1. The discharge of $C1_A$ and $C1_B$ is respectively determined by the conductive states of current controlled devices $12_A$ and $S2_A$ and $12_B$ and $S2_B$, which, in turn, are respectively rendered conductive or inhibited from conduction by the switching means $S1_A$ and transistor $Q4_A$ and switching means $S1_B$ and transistor $Q4_B$. The discharge and charging of $C1_A$ and $C1_B$ is best described with reference to the circuit arrangement 10 of FIG. 2.

In a manner as previously discussed, the sub-arrangement A of circuit arrangement 10 related to the discharging and charging of $C1_A$ is only to be described with the understanding the description is also applicable to the sub-arrangement B charging and discharging of $C1_B$.

Referring now to FIG. 2, initially $C1_A$ is charged to the peak line A.C. voltage through diodes $D1_A$ and $D3_A$. During the positive half-cycle (L1 positive relative to L2) $S1_B$ is conducting in response to the positive voltage applied via $R1_B$, whereas, during the negative half-cycle (L2 positive relative to L1) $S1_A$ is conducting in response to the positive voltage applied via $R1_A$.

On the positive half-cycle, $Q4_A$ is conductive via the positive voltage applied via $R5_A$. The conduction of $Q4_A$ inhibits the triggering and subsequent conduction of switching means $S2_A$. Switching means $S2_A$ is only allowed to conduct once during a selected portion of the positive half-cycle of the line voltage.

During a major portion of the negative half-cycle current is flowing from terminal L2, through diode $D1_B$ up through the arc tube and filament, through $D2_A$, and $S1_A$ back to terminal L1. The current flowing through diode $D2_A$ back biases or reverse biases the transistors $Q1_A$, $Q2_A$ and $Q3_A$ so as to inhibit current flowing through $S2_A$ so that $S2_A$ is maintained in its non-conductive state.

Referring now to FIGS. 4(*a*), 4(*b*), 4(*c*) and 4(*d*), more particularly, to the segment 24 of FIG. 4 related to FIGS. 4(*a*), 4(*b*), 4(*c*) and 4(*d*), it is seen that during the negative half-cycle of FIG. 4(*a*), and a small portion of the positive half-cycle; transistor $Q4_A$ of FIG. 4(*b*) is in a non-conductive (open) state, and, in turn, allows $S2_A$ to be triggered into conduction with the voltage of $C1_A$ via the path of $R4_A$ and $R3_A$. However, $S2_A$ does not immediately conduct, due to the aforementioned back-biased condition of $12_A$.

At the beginning of the positive half-cycle, the no longer back-biased condition of current controlled device $12_A$ in turn allows switching means $S2_A$ to conduct, as shown in FIG. 4(*c*) as device $S2_A$ transitioning from its open to its closed state. The closure of $S2_A$ forward biases device $12_A$, via resistor $R2_A$ causing device $12_A$ to saturate. The closed state of each of the current control device $12_A$ and the switching means $S2_A$ provides the path for discharging the energy stored in capacitor $C1_A$ into the gas discharge tube which inhibits the extinction of the arc of the gas discharge tube that may typically occur during the zero condition of the A.C. voltage of FIG. 4*a*.

As the voltage from the $C1_A$ decays to a value below that of the A.C. line, the switching means $S2_A$ is rendered non-conductive shown in FIG. 4(*c*) as switching means $S2_A$ transitioning from its closed to its open state, and rendered not retriggerable as shown in FIG. 4(*b*) by event 30. At this juncture the line current is flowing through $D1_A$ and supplies the current to maintain the arc condition of the gas discharge tube. Further, at this juncture the lamp current now flows through diode $D2_B$ which reverse biases the current controlled device $12_B$ rendering it non-conductive as shown in FIG. 4(*g*).

The transistor $Q4_B$ of FIG. 4(*c*), switching means $S2_B$ of FIG. 4(*f*), and current controlled device $12_B$ of FIG. 4(*g*) operate during the transition of the negative half-cycle of FIG. 4(*a*) through its zero condition in a manner similar to that respectively described for transistor $Q4_A$, switching means $S2_A$, and current controlled device $12_A$ so as to inhibit the arc extinction of the gas discharge tube during the positive half-cycle zero condition. Further, the description of event 30 is equally applicable to event 34.

The circuit arrangement 10 provides a timed pulse addition (TPA) at the beginning of a cycle of the A.C. voltage of FIG. 4(*a*). The timed pulse addition (TPA) at the beginning (Pre) is herein termed a Pre-TPA.

The duration of the conductive and non-conductive states of switching means $S1_A$ is primarily determined, in part, by the value of resistance selected from $R1_A$, whereas, the duration of the conductive and non-conductive states of current controlled device $12_A$ is determined, in part, by the resistive value of $R2_A$. It is important that the value selected for $R2_A$ be such as to cause the current controlled device $12_A$ to be driven into its saturated condition when it is rendered conductive.

Further, the durations of the conductive states of transistor $Q4_A$ is determined by the resistive value of resistor $R5_A$, whereas, the durations of the conductive states of switching means $S2_A$ is determined, in part, by the resistive values selected for $R3_A$ and $R4_A$. Typical values for $R1_A$, $R2_A$, $R3_A$, $R4_A$ and $R5_A$ along with the typical component for $S1_A$ have been given in Table 2. The above description related to the values and components selections for device $12_A$ is equally applicable to device $12_B$.

Further, the capacitive value selected for the capacitive energy storage means $C1_A$ and $C1_B$ should be such as to supply enough stored energy to be discharged into the gas discharge tube so that the gas discharge tube does not extinquish when the voltage of FIG. 4(*a*) transitions through its zero condition.

It should be recognized that the desired selected value of $C1_A$ is also determined by the duration (controlled by the devices $S1_A$, $12_A$, $Q4_A$, and $S2_A$) allowed for charging and discharging $C1_A$ and similarly the duration (controlled by the devices $S1_B$, $12_B$, $Q4_B$ and $S2_B$) allowed for charging and discharging $C1_B$.

The current controlled devices $12_A$ and $12_B$ of FIG. 2 are of substantial importance to the present invention in that these devices each act as one-way switches which safeguard against inadvertent conduction of these devices allowing current to be fed back into the A.C. line. The switching means $12_A$ and $12_B$ are each arranged in a circuit so as to accept a bias current flowing into the first electrode ($14_A$ or $14_B$) to render the switching device $12_A$ or $12_B$ conductive such that current flows from the third electrode $18_A$ or $18_B$) to the second electrode ($16_A$ or $16_B$). The second electrode $16_A$ or $16_B$ is in a circuit effective to supply current to the gas discharge tube during its conductive state. As previously mentioned, the terminal $16_A$ or $16_B$ is connected back to the terminal $14_A$ or $14_B$, respectively, by diodes $D2_A$ or diode $D2_B$ each serving as interconnection means and each providing a predetermined voltage drop and preferential conduction from the second electrode ($16_A$ or $16_B$) to the first electrode ($14_A$ or $14_B$). The operation of these interconnecting means is such that when the current flowing through diode $D2_A$ or $D2_B$ establishes a voltage drop across diode $D2_A$ or $D2_B$ of typically 0.75 volts the current controlled devices $12_A$ or $12_B$, respectively, are back biased or reverse biased and therefore inhibited from conduction. If the current controlled device $12_A$ or $12_B$ is inadvertently rendered conductive, the current flowing out of the emitter of $Q1_A$ or $Q1_B$ is preferentially directed back toward and through the diode $D2_A$ or $D2_B$ respectively. The current flowing through diode $D2_A$ or $D2_B$ causes a voltage drop of approximately 0.75 volts, which, in turn, automatically inhibits the inadvertent conduction of current controlled device $12_A$ or $12_B$. In this manner, controlled device $12_A$ or $12_B$ acts as a one-way switch only passing current into its desired path toward the gas discharge tube.

The current controlled device $12_A$ or $12_B$ shown in FIG. 2 may be modified by removing the serially arranged diodes $D4_A$, $D5_A$ and $D6_A$ or $D4_B$, $D5_B$ and $D6_B$. These diodes $D4_A$ . . . $D6_B$ provide a desired voltage drop during the forward conduction of device $12_A$ and $12_B$, but it has been determined that their removal may be accomplished and the current controlled devices $12_A$ and $12_B$ operate in their described manner, if the characteristics of specific transistors used for $Q1_A$, and $Q2_A$, and $Q3_A$ or $Q1_B$, $Q2_B$ and $Q3_B$ permit saturation in the conductive states without diodes $D4_A$ . . . $D6_B$.

Another embodiment of the present invention is shown in FIG. 5 for a circuit arrangement 40. The circuit arrangement 40 of FIG. 5 is similar to the circuit arrangement 10 of FIG. 2 with the exception that circuit arrangement 40 does not have the networks $30_A$ and $30_B$ of FIG. 2. The elements of the circuit arrangement 40 have the same reference number and the same general description of the elements of the circuit arrangement 10. The essential operating condition between circuit arrangements 10 and 40 is that as previously described the circuit arrangement 10 of FIG. 2 applies a PRE-TPA to the gas discharge tube, whereas, the circuit arrangement 40 of FIG. 5 applies a TPA both at the beginning and at the end of the cycle of the A.C voltage of FIG. 4(*a*). The operation of the circuit arrangement 40 is herein termed "FULL TPA."

Figure 6:
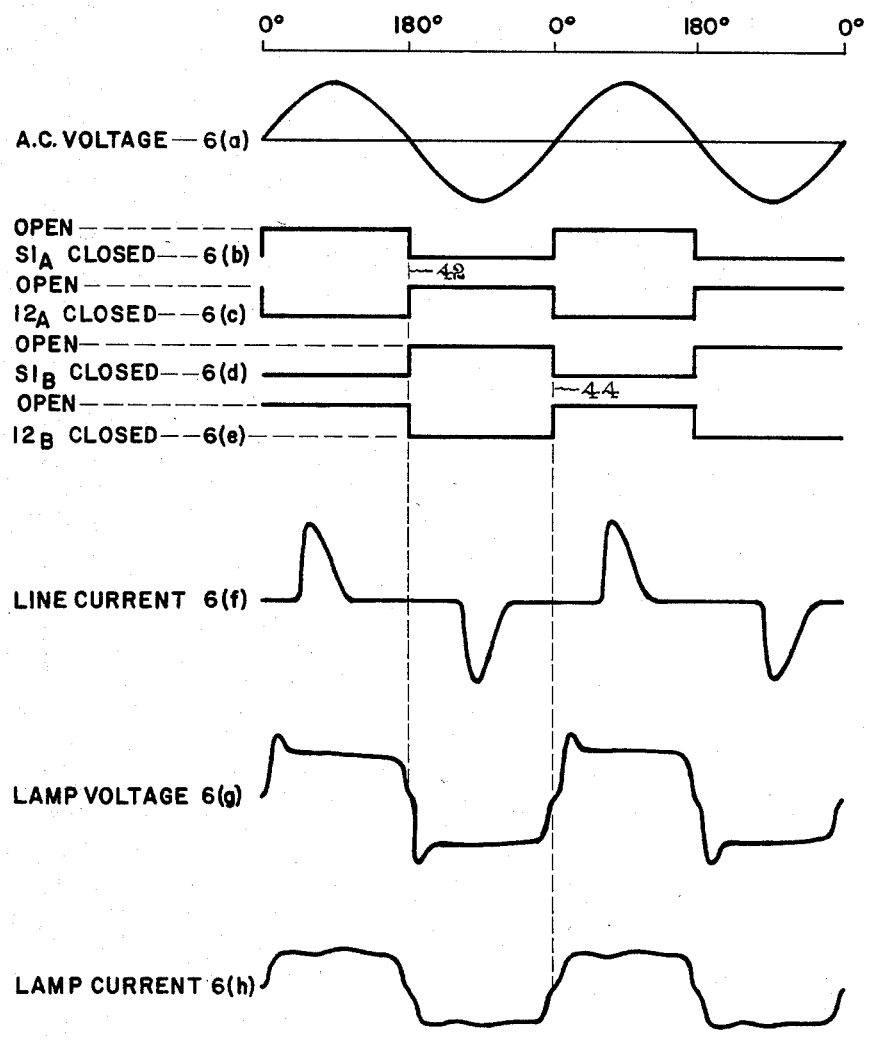
FIG. 6 is a timing diagram related to the operation of the circuit of FIG. 5.

The operation of the circuit arrangement 40 of FIG. 5 may be described by referring to the timing diagram of FIG. 6. FIG. 6 is similar to FIG. 4 in that it is segmented into eight (8) Figures, (1) FIG. 6(*a*) showing the applied A.C. voltage of FIG. 5, (2) FIG. 6(*b*) showing the closed and open states of the switching means $S1_A$, (3) FIG. 6(*c*) showing the closed and open states of current controlled device $12_A$, (4) FIG. 6(*d*) showing the closed and open states of the switching means $S1_B$, (5) FIG. 6(*e*) showing the closed and open states of the current controlled device $12_B$, (6) FIG. 6(*f*) showing the waveform of the line current flowing into terminal $L_1$ and out of terminal $L_2$ and defined as "positive" in polarity, (7) FIG. 6(*g*) showing the waveform of the lamp voltage and (8) FIG. 6(*h*) showing the waveform of the lamp current. In a manner similar to that described for FIG. 4(*i*), from FIG. 6(*g*) it should be noted that the lamp voltage has a waveshape resembling that of a square-wave.

The conductive states of current controlled devices $12_A$ and $12_B$ of FIG. 5 primarily determine the discharge state of energy storage devices $C1_A$ and $C1_B$ respectively. Supplying the timed pulse additions (TPA) of FIG. 6(*g*) in a manner previously disclosed for FIG. 2 for the conductive states of the current controlled device $12_A$ is only to be described.

As previously discussed with regard to FIG. 2, when the switching means $S1_A$ is rendered nonconductive, shown in FIG. 6(*b*) as switching means $S1_A$ transitioning from its closed to its open state, the current controlled device $12_A$ is rendered conductive which is shown in FIG. 6(*c*) by the transition of $S1_A$ from its open to its closed state.

As soon as current controlled device $12_A$ is rendered conductive, the energy stored in $C1_A$ is discharged into the gas discharge tube via the path $22_A$, shown in FIG. 5, which, is seen in the lamp current waveform of FIG. 6(*h*) as the positive-going spike at the beginning of the half cycle. The energy of $C1_A$ is discharged into the gas discharge tube until the line voltage of FIG. 6(*a*) increases and becomes substantially equal to the voltage of capacitor $C1_A$. At this juncture current is supplied to the gas discharge tube by the line current (FIG. 6(*f*)) and this line current also recharges $C1_A$ by way of path provided by diode $D3_A$. Subsequently as the line voltage (FIG. 6(*a*)) starts to fall, while current controlled device $12_A$ is still conducting, discharge current again flows out of $C1_A$ into the gas discharge tube, adding current to the line waveform and producing an augmented tail. Subsequently, as shown in FIGS. 6(*b*) and 6(*c*) by event 42, switching means $S1_A$ transitions to its closed state, which, in turn, causes current control device $12_A$ to transition to its open state as the negative going voltage of the lamp voltage 6(*g*) starts to increase for operation of the negative half cycle through device $12_B$. The circuit arrangement 40 of FIG. 5 operating in a manner as described with reference to FIG. 6 maintains the desired arc condition of the gas discharge tube even though the applied A.C. voltage transitions through its polarity reversed.

Figure 10:
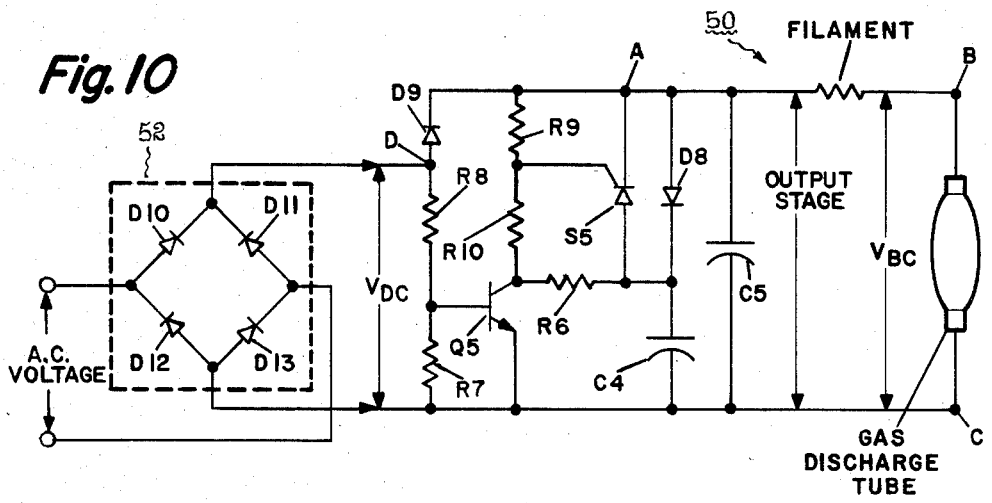
FIG. 10 is a circuit arrangement of the further embodiment of the present invention FIG. 11 show various waveforms related to the operation of the circuit of FIG. 10.

The amount of energy developed by either of the circuit arrangements 40 of FIGS. 5 or 10 of FIG. 2 may be increased by changing the selected value of capacitors $C1_A$ and $C1_B$ from 10 microfarads to 50 microfarads. The 50 microfarads capacitors $C1_A$ and $C1_B$ increased the amount of stored energy which is discharged into the gas discharge tube by a factor of five (5) to one (1) relative to the 10 microfarads capacitors $C1_A$ and $C1_B$.

The circuit arrangement 10 and 40, supplies the desired TPA without releasing electromagnetic energy back onto the applied A.C. voltage. Further, although current controlled devices $12_A$ and $12_B$ have been described as bipolar devices, the function of devices $12_A$ and $12_B$ may also be implemented with MOS devices, such as VMOS field effect transistors, or insulated-gate rectifiers or any device capable of being turned on and off with a control bias of the nature described. Only diodes $D1_A$, $D3_A$ and $D1_B$ and $D3_B$ are necessary to recharge the capacitor $C1_A$ and $C1_B$, respectively. Still further, the practice of this invention contemplates the usage of a single device for $12_A$ and $12_B$, such as a custom designed bipolar device or commercially available Power MOSFET or IGR (Insulated Gate Rectifier) devices. Further still, although $S1_A$, $S1_B$, $S2_A$ and $S2_B$ have been disclosed as a Silicon Controlled Rectifier (SCR) the practice of this invention contemplates the usage of a power MOSFET or IGR devices for either $S1_A$, $S1_B$, $S2_A$ or $S2_B$.

A further embodiment of the present invention is provided by alternating the circuit arrangement 40 of FIG. 5. The alternation is accomplished by interposing a resistive element between each of the anode of diode $D4_A$ of the current controlled device $12_A$ and diode $D4_B$ of the current-controlled device $12_B$ and their respective capacitor $C1_A$ and $C1_B$. The operation of the circuit arrangement 40 of FIG. 5 having the added resistive element is best described with reference to FIG. 7.

Figure 7:
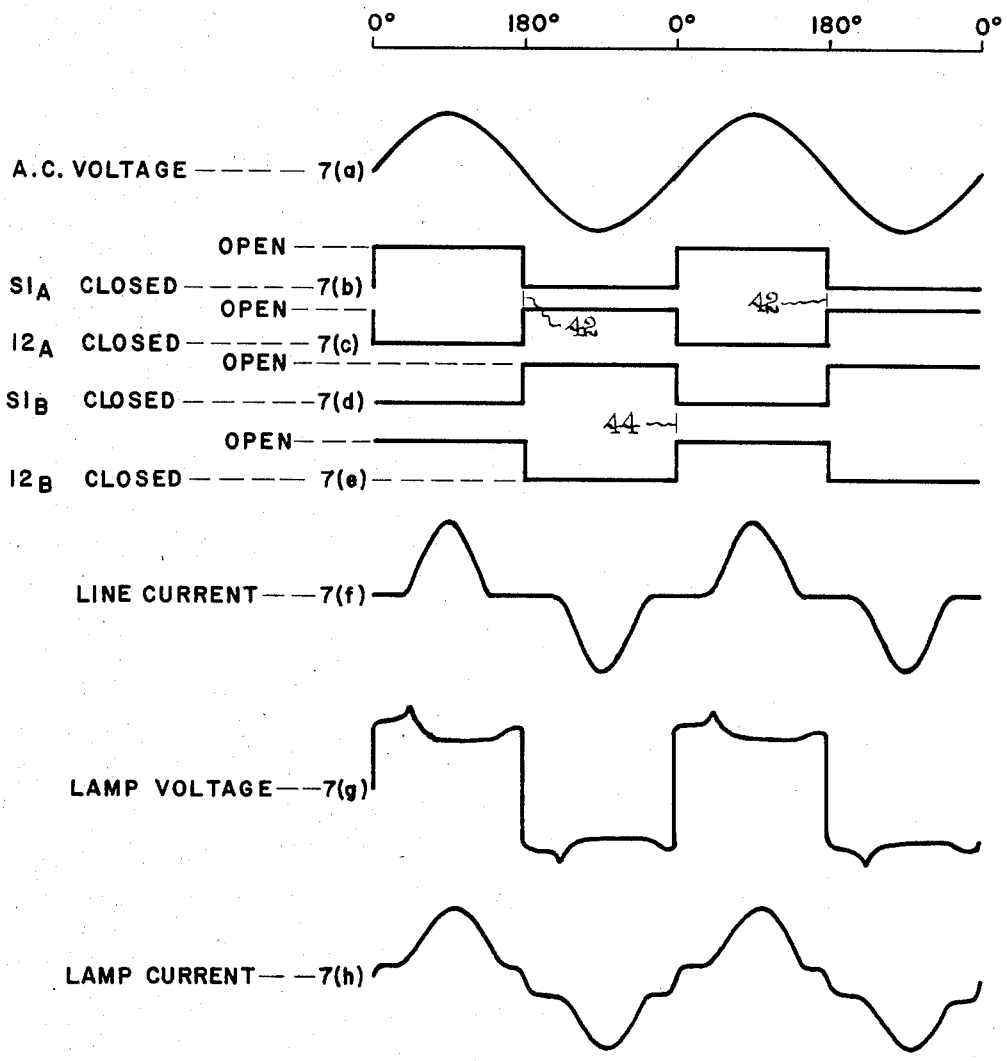
FIG. 7 is a timing diagram related to the operation of an alternate embodiment of the circuit of FIG. 5.

FIG. 7 is similar to the previously described FIG. 6 except for the waveshapes of FIG. 7(*g*) showing the lamp voltage and FIG. 7(*h*) showing the lamp current. A comparison between FIG. 6(*g*) and FIG. 7(*g*) and FIG. 6(*h*) and FIG. 7(*h*) reveal that: (1) the lamp voltage of FIG. 7(*g*) has a square waveshape that has a positive and negative peak portions which occur later in the cycle than FIG. 6(*g*) and these peak portions slowly decay but rise again later in the cycle; and (2) the lamp current of FIG. 7(*h*) has a waveshape having higher positive and negative peaks than those of FIG. 6(*h*) that occur in the central portion of the applied A.C. voltage of FIG. 7(*a*) and the initial and terminal portions of each half-cycle of the lamp current of FIG. 7(*h*) have a plateau-like waveshape. The plateaus along with the peaked portions are indicative that lamp current is substantially, continuously flowing in the gas discharge tube even though the applied A.C. voltage of FIG. 7(*a*) delays and rises in a sinusoidal manner through its polarity reversed conditions. The resistor added to the circuit arrangement 40 adjusts the discharge time constant of the capacitors $C1_A$ and $C1_B$ and provides for the plateau waveshape of FIG. 7(*h*).

The value of the resistive element added to the circuit arrangement 40 of FIG. 5 may be selected so as to adjust or adapt the discharge time constant of the capacitor $C1_A$ or $C1_B$ into the gas discharge tube of FIG. 5. The discharge time constant may be selected so as to preferentially adapt the circuit arrangement 10 to the needs of the gas discharge tube of FIG. 5. For the waveshape shown in FIG. 7 the resistive element was selected to have a value of 1500 Ω and the capacitors $C1_A$ and $C1_B$ had a value of 10 μF.

Although the addition of the resistive element has been described with reference to circuit arrangement 40 of FIG. 5, it should be recognized that the resistive element may also be added to the circuit arrangement 10 of FIG. 2 in a manner as described for FIG. 5.

It should now be appreciated that the various embodiments of the present invention provide Timed Pulse Additions (TPA) to occur during various portions by the applied A.C. voltage so as to continuously maintain the arc condition of the gas discharge tube during its steady-state mode of operation.

The present invention is further directed to a ballast circuit that operates in response to a rectified A.C. voltage applied to its input. The ballast circuit responsive to a rectified A.C. is best described by first referring to FIG. 8.

Figure 8:
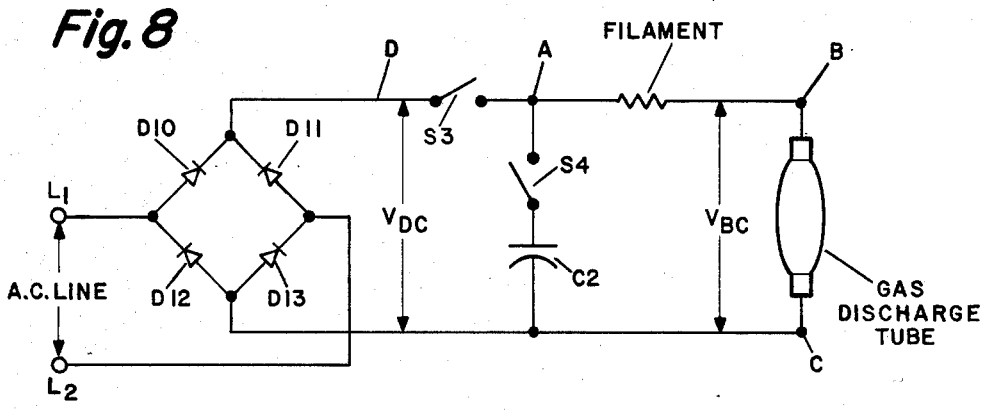
FIG. 8 is a simplified diagram of a further embodiment of the present invention shown in FIG. 9.

FIG. 8 shows an A.C. line applied across a conventional full-wave rectifier formed of diodes D10, D11, D12 and D13 arranged as shown in FIG. 8. FIG. 8 further shows a location D at the input of a switching means 53, a location A at the input to a switching means 54 and locations B and C oppositely located across the gas discharge tube. The full-wave rectifier develops an undulating D.C. voltage $V_{DC}$ which is applied to the FILAMENT and GAS DISCHARGE TUBE under control of the closed state of switching means S3 while switching means S4 is in its open state. The states of switching means S4 controls the coupling of the capacitor C2 into and out of the circuit of FIG. 8.

The circuit of FIG. 8 operates in a similar manner as that of FIG. 3 in that the charging and discharging of capacitor C2 is accomplished so that Timed Pulse Additions (TPA) are supplied to the gas discharge tube only when there is a danger that the arc condition of the gas discharge tube may extinquish due to the zero voltage conditions related to the developed D.C. voltage $V_{DC}$. The zero voltage conditions related to the developed D.C. voltage $V_{DC}$ and the general interrelationships of the circuit of FIG. 8 may be best described by reference to FIG. 9 along with reference to the circuit of FIG. 8.

Figure 9:
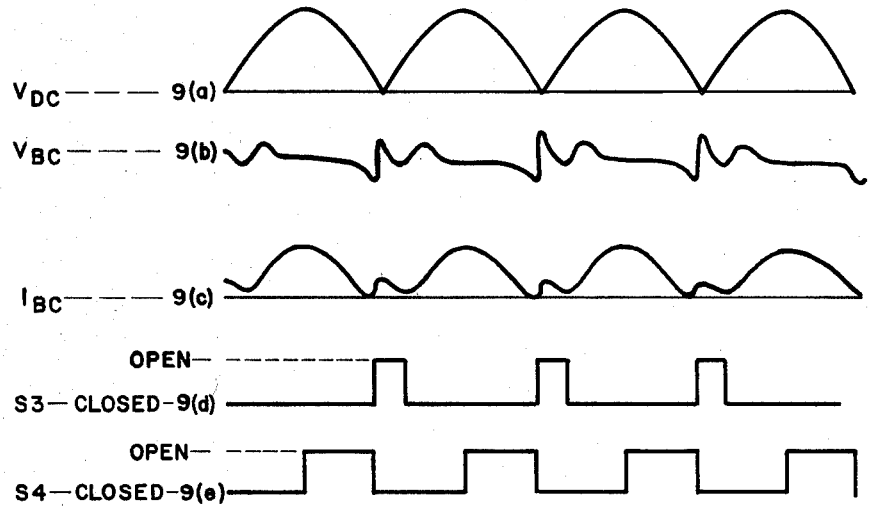
FIG. 9 is a timing diagram related to the operation of the circuit of FIG. 8.

FIG. 9 is segmented into five (5) sections, (1) FIG. 9(*a*) showing the D.C. voltage $V_{DC}$ of FIG. 8, (2) FIG. 9(*b*) showing the waveform of voltage $V_{BC}$ of FIG. 8 applied across the gas discharge tube, (3) FIG. 9(*c*) showing the waveform of the current $I_{BC}$ flowing through the gas discharge tube, (4) FIG. 9(*d*) showing the closed (conductive) and open (non-conductive) states of switching means S3, and (5) FIG. 9(*e*) showing the closed (conductive) and open (non-conductive) states of switching means of switching means S4.

Initially switching means S3 and S4 are both in their closed state so that capacitor C2 is charged to the peak value of the first cycle of the $V_{DC}$ signal of FIG. 9(*a*) and the $V_{DC}$ signal is also applied to the gas discharge tube. Switching means S4 is opened as soon as the current charging the capacitor C2 reaches a zero condition, thereby isolating the charge of C2 for use on the next cycle of $V_{DC}$ of FIG. 9(*a*). The current flowing through switching means S3 maintains the arc condition of the gas discharge tube during most of the remainder of the cycle.

At the end of the cycle, of $V_{DC}$ of FIG. 9(*a*), switching means S3 is opened and concurrently switching means S4 is closed, which, in turn, causes the full-peak voltage on the capacitor C2 to be relatively instantly discharged into the gas discharge tube so as to maintain its arc condition. At this juncture, the positive-going voltage $V_{DC}$ at point D of FIG. 7 is rising toward its peak value.

As soon as the voltage difference between point D and point A is approximately zero, the switching means S3 is closed. At this zero difference condition the voltage of $V_{DC}$ has risen to a value capable of maintaining the arc condition of the gas discharge tube. The voltage $V_{DC}$ continues to rise and recharge the capacitor $C_2$. A circuit arrangement 50 which operates in the manner as described for the general diagram of FIG. 7 is shown in FIG. 10.

FIG. 10 shows the circuit arrangement 50 as having an A.C. voltage applied across the full-wave rectifier 52 formed of diodes D10, D11, D12, and D13 previously discussed with regard to FIG. 8. FIG. 10 further shows a plurality of elements of the type or having the typical values given in Table 3.

TABLE 3

| Element | Type |
|---|---|
| R6 | 100K, ¼ watt carbon composition resistor |
| R7 | 1.8K, ¼ watt carbon composition resistor |
| R8 | 200K, ¼ watt carbon composition resistor |
| R9 | 15K, ¼ watt carbon composition resistor |
| R10 | 100K, ¼ watt carbon composition resistor |
| D8, D9, D10, D11, D12, and D13 | 1 amp, 400 PIV Silicon Diode |
| S5 | Silicon Controlled Rectifier of Teccor Co. type 2N5064 |
| Q5 | Silicon transistor of Motorola type 2N6517 |

FIG. 10 further shows capacitors C4 and C5 whose values are to be described with regard to the operation of the circuit arrangement 50.

FIG. 10 shows the output $V_{DC}$ of the D.C. rectifier 52 applied across a serial arrangement of resistors R7 and R8. A node formed from one end of each of the resistors R7 and R8 is connected to the base of transistor Q5. The other end of resistor R8 is connected to the anode of a forward conducting diode D9 having its cathode connected to one end of resistor R9. The other end of resistor R7 is connected to the emitter of transistor Q5 which has its collector connected to a node formed from one end of each of a resistor R6 and a resistor R10. The other end of resistor R10 is connected to (1) the other end of resistor R9, and to (2) the gate of switching means S5.

The other end of resistor R6 is connected to, (1) the anode of switching means S5, (2) the cathode of diode D8, (3) and to one end of capacitor C4 having its other end connected to one end of capacitor C5 and to the emitter of transistor Q5. The switching means S5 has its cathode connected to the anode of diode D8. The switching means S5, connected to diode D8, is similar to that shown in the network $30_A$ and $30_B$ in that it is a voltage control device having a first terminal (gate) connected to a bias network, a second terminal (cathode) connected to the terminal of the output stage, and third terminal (anode) connected to storage capacitor means C4.

The diode D8 along with capacitor C4 is arranged in a parallel manner across capacitor C5, which, in turn, is arranged in a parallel manner across a serial arranged filament and gas discharge tube. The gas discharge tube has a starting circuit 11 (not shown in FIG. 9) but previously referred to with regard to FIG. 2.

The circuit arrangement 50 has capacitor C4 and C5 each having various values from 0 to approximately 50 microfarads selected so as to accomplish various desired circuit operations of the circuit arrangement 50. One of the desired operations may be described by referring to FIG. 11 along with FIG. 10 with the assumption that C5 has a value of zero and C4 has a value of approximately 2 microfarads.

Figure 11:
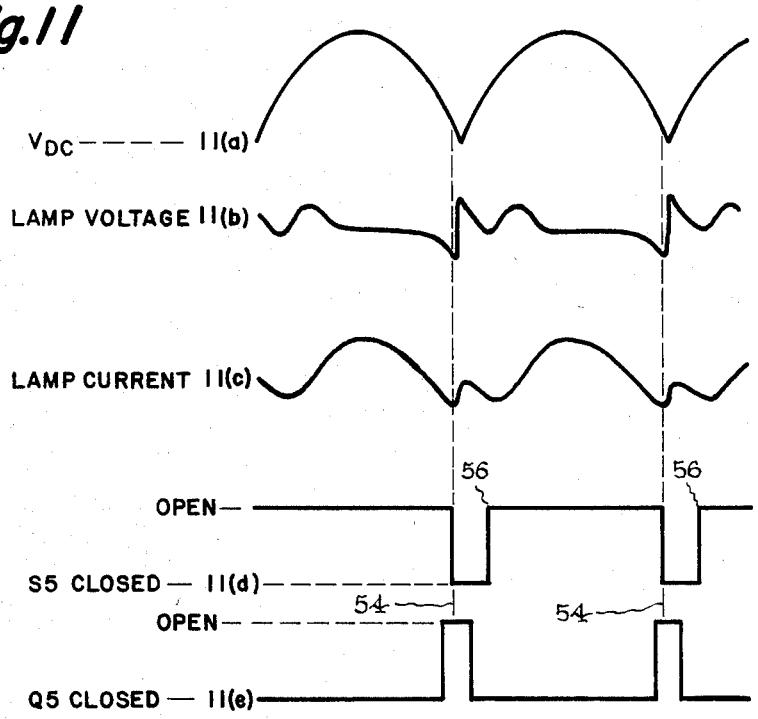

FIG. 11 is segmented into five (5) sections: (1) FIG. 11(*a*) showing the waveform of the applied voltage $V_{DC}$; (2) FIG. 11(*b*) showing the lamp voltage of the gas discharge tube; (3) FIG. 11(*c*) showing the line current flowing thru the filament and gas discharge tube; (4) FIG. 11(*d*) showing the open (non-conductive) and closed (conductive) states of the switching means S3; and (5) FIG. 11(*e*) showing the open (non-conductive) and closed (conductive) states of the transistor Q5.

Initially capacitor C4 is charged to the peak values of $V_{DC}$ of FIG. 11(*a*) via the path formed from diodes D8 and D9. During this condition, the full-wave rectified voltage $V_{DC}$ of FIG. 11(*a*) at point D (FIG. 10) causes the conduction of Q5 via, the path of resistor R8 and is shown in this conductive state in FIG. 11(*e*) as Q5 in its closed state. Similarly, during this condition switching means S5 is inhibited from conduction via the conducting state of Q5 and is shown in this inhibited state in FIG. 11(*d*) in S5 open state. When the $V_{DC}$ voltage of FIG. 11(*a*) falls towards its low portion, it reaches a value, shown as an event 54 related to FIGS. 11(*a*), 11(*d*) and 11(*e*), so that Q5 is inhibited from conduction which is shown in FIG. 11(*e*) as Q5 transitioning from its closed to its open state. The open state of Q5 causes the voltage applied to the collector of Q5 to rise, which, in turn, allows the gate of switching means S5 to be triggered through the path provided by R6 and R10, thereby rendering S5 conductive as shown in FIG. 11(*d*) by S5 transitioning from its open to its closed state. The conduction of S5 causes the initially charged capacitor C4 to be effectively connected to point A of FIG. 9.

Initially, the voltage at point A is higher than the $V_{DC}$ voltage of FIG. 9(*a*) at point D so that diode D9 is back biased allowing the energy stored in capacitor C4 to discharge through the gas discharge tube. The discharge of capacitor C4 is manifested by the sudden rising spikes shown in both FIGS. 11(*b*) and 11(*c*) related to the bottom portion of $V_{DC}$ of FIG. 11(*a*). As the discharge voltage of $C_4$ starts its decay, the voltage of $V_{DC}$ at point D starts its rise. Subsequently, when the voltage at point D exceeds that at point A, the line current flows through D9 and begins to operate the gas discharge tube for the remaining portion of $V_{DC}$ until the reoccurrence of event 54. During this time capacitor C4 recharges to the line peak. The switching means S5 is automatically rendered non-conductive when the current flowing through it falls to zero, shown by event 56, correspondingly causing S5 to transition from its closed to its open state, which condition occurs before the recharge current for C4 flows through diode D8.

The operation of the circuit arrangement 50 is similar to the circuit arrangement 10 and 40 of FIGS. 2 and 5, respectively, in that circuit arrangement 50 provides Timed Pulse Additions (TPA) to the gas discharge tube when the applied voltage $V_{DC}$ approaches a zero condition so as to continuously maintain the arc condition of the gas discharge tube during its steady-state mode of operation.

Figure 12:
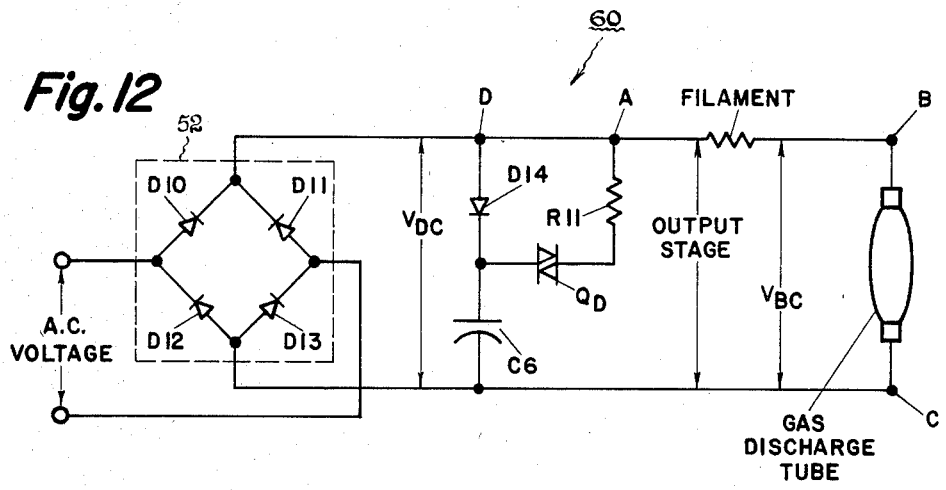
FIG. 12 is a circuit arrangement of a still further embodiment of the present invention.

A further embodiment of the present invention of a ballast circuit that operates in response to a rectified A.C. voltage applied to its inputs is shown in FIG. 12.

FIG. 12 shows a circuit arrangement 60 comprising the full-wave rectifier 52, the filament and the gas discharge tube all described with reference to FIG. 10. The circuit arrangement 60 further comprises a diode D14 of a 1 amp, 400 PIV silicon type, a capacitor C6 similar to capacitor C4 described for FIG. 10 having a typical value of 10 μF, a SIDAC device $Q_D$ of the type K1050E of Teccor Co., having an inherent characteristic breakdown or turn-on voltage of approximately 105 volts and a preferred resistor R11 interposed between the capacitor C6 and discharge tube for adjusting the discharge time of capacitor C6 in a similar manner as previously described with regard to the resistive element that may be added to circuit arrangements 10 or 40.

The circuit arrangement 60 operates in a manner similar to circuit arrangement 50 and may be described with reference to FIGS. 11(*a*), 11(*b*) and 11(*c*). In the operation of circuit arrangement 60, initially the capacitor C6 is charged to the peak value of $V_{DC}$ FIG. 11(*a*), having a value in the order of 150 volts, via the path provided by diode D14.

When the $V_{DC}$ voltage of FIG. 11(*a*) falls towards its low portion, the voltage across the lamp 11(*b*) also falls and when the voltage across the lamp 11(*b*) reaches a typical value of 45 volts a voltage difference of approximately 105 volts exists across the SIDAC $Q_D$. This 105 volts is established by one side of the SIDAC $Q_D$ being connected to the charged (150 volts) capacitor C6 and the other side connected, via resistor R11, to the gas discharge tube at the voltage of 45 volts. For this 105 volt condition the SIDAC $Q_D$ breaks down or turns on causing the energy (timed pulse addition) to be discharged into the gas discharge tube so as to continuously maintain the arc condition of the gas discharge tube during its steady-state mode of operation.

Figure 13:
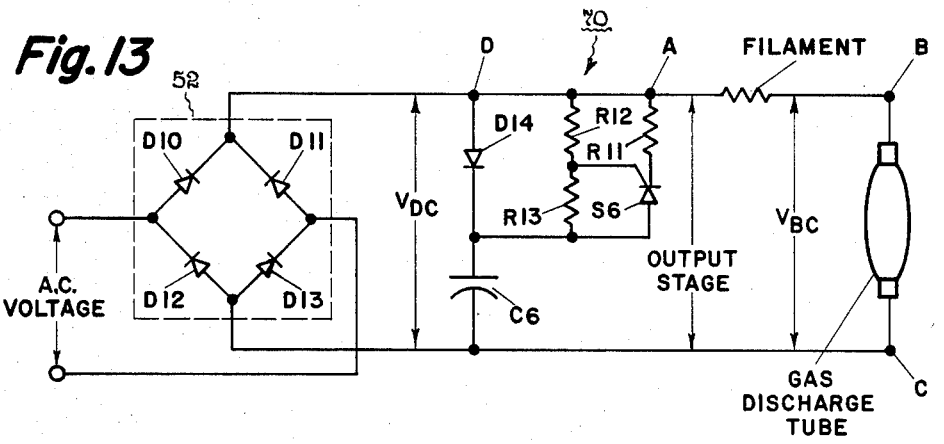
FIG. 13 is a circuit arrangement of another embodiment of the present invention.

Another embodiment of the present invention of a ballast circuit that operates in response to a rectified A.C. voltage applied to its inputs is shown in FIG. 13.

FIG. 13 shows a circuit arrangement 70 similar to the circuit arrangement 60 of FIG. 12 but having a silicon-controlled rectifier (SCR) S6 and serially arranged resistors R12 and R13 connected across diode D14 all in place of the SIDAC $Q_D$ of FIG. 12. The silicon-controlled rectifier S6 has a breakdown voltage determined by the second bias network formed by the arranged resistors R12 and R13. The node of the resistors R12 and R13 is connected to the gate electrode of device S6, whereas, the anode of device S6 is connected to capacitor C6 and the cathode of device S6 is connected to the output stage via resistor R11.

The resistor R12 has a typical value of 1000 ohms resistor R13 has a typical value of 130 K ohms and the silicon-controlled rectifier S6 may be of the type 2N5064 of Teccor Co.

The circuit arrangement 70 operates in a manner similar to that described for circuit arrangement 60. The SCR device S6 of circuit arrangement 70 is rendered conductive, at the previously discussed 105 volt condition of the SIDAC $Q_D$, causing the discharge of the stored energy of the capacitor C6 into the gas discharge so as to continuously maintain the arc condition of the gas discharge tube during its steady state mode of operation. The silicon control rectifier S6 is rendered conductive at this 105 volt condition by the selections of resistance values of R12 and R13 and the selection of the type of the SCR as all previously given with regard to FIG. 13.

Figure 14:
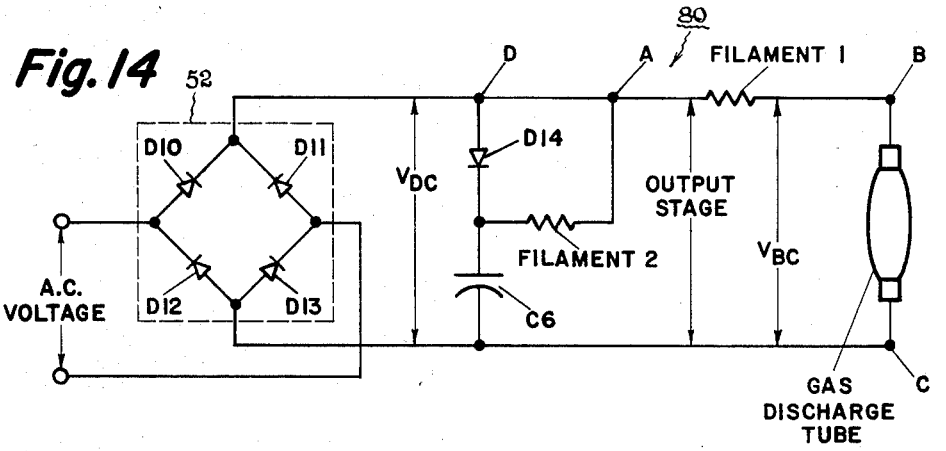
FIG. 14 is a circuit arrangement of a further embodiment of the present invention.

A still further embodiment of the present invention is shown in FIG. 14 as a circuit arrangement 80. Circuit arrangement 80 is similar to the previously described circuit arrangements 60 and 70 with the exception that the discharge path of the stored energy of capacitor C6 to the gas discharge tube is provided by a second filament FILAMENT 2.

FILAMENT 2 is particularly advantageous in the circuit arrangement 80 in that, (1) it can provide additional incandescent supplementary light to the improved lighting unit 10 of FIG. 1, (2) its resistance value is a function of the temperature of the environment (improved lighting unit 10) in which it is lodged. The resistance value of FILAMENT 2 increases due to self-heating from the current passing thru it, and also increases as the temperature of the environment in which it is lodged increases which is particularly suitable for the improved lighting unit 10.

During the initial starting of the gas discharge tube the environment of the improved lighting unit is at the lower end of its operating temperature range so that the FILAMENT 2 is at its lower end of its resistance value range. The FILAMENT 2 during this lower temperature condition provides a low resistance discharge path of the stored energy of capacitor C6 into the gas discharge tube which augments the starting of the gas discharge tube. Further, as the temperature of the improved lighting unit 10 increases due to heat created by the operating discharge tube, the resistance value of the FILAMENT 2 also increases, which, in turn, increases the resistance of the discharge path of capacitor C6, which, in turn, reduces the stored energy discharged into the operating gas discharge tube.

The resistance of FILAMENT 2 may be adapted to the environment of the lighting unit 10 to improve the operational response of the gas discharge tube by the appropriate selection of the parameters, such as wire diameter, wire length, and coil winding configuration of the FILAMENT 2.

The resistance of FILAMENT 2 may be further adapted to improve the operational response of the gas discharge tube by appropriate placement within the improved lighting unit 10. The FILAMENT 2 may be appropriately lodged, in a preferred manner, in close proximity to the gas discharge tube, shown in FIG. 1 as disposed within the light-transmissive outer envelope 62, so that it provides a low resistance discharge path for capacitor C6 during the initial starting of the gas discharge tube but its resistance discharge path is increased is a relatively rapid manner due to the rapidly developing heat of the operating gas discharge tube. The appropriate lodging and parameter selection of FILAMENT 2 may be further adjusted to control the discharge rate of capacitor C6 in a manner similar to that desired for the added resistant element of FIGS. 2, 5, 10, 12 and 13. It should be appreciated that the hereinbefore given discussion related to the connection of FILAMENT 2 to point A in FIGS. 12, 13, and 14, applies as well to an alternative connection of FILAMENT 2 to point B.

It should now be appreciated that the present invention provides ballast circuits applicable to both direct A.C. and rectified A.C. applied voltages. The ballast circuits of the present invention only supply Timed Pulse Additions to the gas discharge tube in the amount necessary to maintain the arc condition of the gas discharge tube in its steady-state mode of operation. Further, the ballast circuits of the present invention are easily adaptable to the various needs of the gas discharge tube.

Although the hereinbefore described circuits are related to a gas discharge tube having a breakdown, glow and steady-state mode, it should be appreciated that the practice of this invention contemplates the use of the described various embodiments with other devices such as (1) a relatively high pressure sodium vapor lamp such as the commonly known LUCALOX ®lamp type of the General Electric Company, and (2) fluorescent and low pressure sodium type arc discharge lamps.

What we claim as new and desire to secure by Letters Patent of the United Stated is:

1. In a lighting unit having a gas discharge tube as a main light source, a starting circuit for said gas discharge tube, a filament serving as a resistive element and as a supplementary light source, and an operating circuit for controlling the steady state run mode of operation of said gas discharge tube, the improvement wherein said operating circuit comprises:

a first and a second input terminal for having applied thereacross an alternating current (A.C.) source voltage;

an output stage having a first and a second terminal which has connected thereacross a serial arrangement of said filament and said gas discharge tube;

a capacitive energy storage means comprising a first capacitor and a second capacitor each provided with means connected to one end thereof for respectively charging each of said first and second capacitors during a preselected portion of said applied (A.C.) voltage and each of said first and second capacitors having the other end thereof connected respectively to an opposite input terminal of said operating circuit a switching means comprising first and second current control devices each having a first, a second and a third terminal;

a first bias network and a second bias network respectively connected to said first terminal of each of said first and said second current control device, said first and said second bias networks being respectively responsive to a selected portion of the cycle of said A.C. voltage effective to respectively render said first and said second current control devices conductive; and said first and said second current control devices each respectively having its second terminal connected to opposite terminals of said output stage, and each of said first and second current control devices having its third terminal respectively connected to said first end of said first and second capacitors effective to respectively discharge said first and second capacitors across said gas discharge tube when said first and second current control devices are rendered conductive.

2. In a lighting unit according to claim 1 the improvement comprising wherein a second filament is interposed between at least one of said capacitors and at least one of said respective switching means, said second filament having preselected parameters effective to establish a predetermined desired discharge time for said at least one of capacitors.

3. In a lighting unit according to claim 1 the improvement further comprising wherein a resistive element is serially arranged with at least one of said capacitors and at least one of said respective switching means, said resistive element having a predetermined value effective to establish a predetermined desired discharge time for said at least one of capacitors.

4. In a lighting unit having a gas discharge tube as a main light source, a starting circuit for said gas discharge tube, a filament serving as a resistive element and as a supplementary light source, and an operating circuit for controlling the steady state run mode of operation of said gas discharge tube, the improvement wherein said operating circuit comprises:

a first and a second input terminal for having applied thereacross a rectified (A.C.) source voltage;

an output stage, having a first and a second terminal which has connected thereacross a serial arrangement of said filament and said gas discharge tube;

a capacitive energy storage means comprising a capacitor provided with means connected to its first end for charging said capacitor during a preselected portion of said rectified A.C. applied voltage and said capacitor having its other end connected to one of said input terminals of said operating circuit;

a switching means comprising a current control device having a first, a second, and a third terminal;

a bias network means connected to said first terminal of said current control device and responsive to a selected portion of said applied rectified A.C. voltage effective to render said current control device conductive;

said current control device having its second terminal connected to one terminal of said output stage, and its third terminal connected to said first end of said capacitor so as to discharge said capacitor across said gas discharge tube when said current control device is rendered conductive, and;

a second filament having preselected parameters and interposed between said capacitive energy storage means and said switching means; said preselected parameters being effective to establish a desired discharge for said capacitive energy storage means.

5. In a lighting unit having a gas discharge tube as a main light source, a starting circuit for said gas discharge tube, a filament serving as a resistive element and as a supplementary light source, and an operating circuit for controlling the steady state run mode of operation of said gas discharge tube, the improvement wherein said operating circuit comprises:

a first and a second input terminal which has applied thereacross a rectified (A.C.) source voltage;

an output stage having a first and a second terminal which has connected thereacross a serial arrangement of said filament and said gas discharge tube;

a capacitive energy storage means comprising a capacitor provided with means connected to its first end for charging said capacitor during a preselected portion of said rectified applied voltage and having its other end connected to one of said input terminals of said operating circuit;

a semiconductor device having a breakdown voltage determined by a bias network, said semiconductor device has its first terminal connected to said first end of said capacitor, its second terminal connected to one terminal of said output stage and its third terminal connected to said bias network, said semiconductor being effective to discharge said capacitor across said discharge tube when the voltage provided by the bias network exceeds said breakdown voltage of said semiconductor device; and a second filament serially arranged with said capacitor and said semiconductor device, said second filament having preselected parameters effective to establish a predetermined desired discharge time for said capacitor.

6. In a lighting unit having a gas discharge tube as a main light source, a starting circuit for said gas discharge tube, a filament serving as a resistive element and as a supplementary light source, and an operating circuit for controlling the steady state run mode of operation of said gas discharge tube, the improvement wherein said operating circuit comprises:

a first and a second input terminal which has applied thereacross a rectified (A.C.) source voltage;

an output stage, having a first and a second terminal which has connected thereacross a serial arrangement of said filament and said gas discharge tube;

a capacitive energy storage means comprising a capacitor provided with means connected to its first end for charging said capacitor during a preselected portion of said rectified applied voltage and having its other end connected to one of said input terminals of said operating circuit; and a second filament connecting said first end of said capacitor to said gas discharge tube having preselected parameters, and being predeterminedly positioned relative to said gas discharge tube, said second filament having preselected parameters effective to establish a predetermined desired discharge time for said capacitor.

7. In a lighting unit according to claim 6 the improvement wherein:

said second filament is positioned in close proximity with said gas discharge tube.

* * * * *